United States Patent [19]

Roccanova

[11] Patent Number: 4,930,788

[45] Date of Patent: Jun. 5, 1990

[54] GEM CAPTURE BOARD GAME

[76] Inventor: Frank Roccanova, 18 Roslyn Ct., North Patchoque, N.Y. 11772

[21] Appl. No.: 401,626

[22] Filed: Mar. 31, 1989

[51] Int. Cl.[5] ..... A63F 3/00; A63F 9/04

[52] U.S. Cl. ..... 273/248; 273/146; 273/243; 273/256

[58] Field of Search ..... 273/248, 258, 243, 264, 273/271, 249, 250–254, 146

[56] References Cited

U.S. PATENT DOCUMENTS

| | | | |
|---|---|---|---|
| 733,793 | 4/1903 | Arriaga | 273/243 |
| 836,878 | 11/1906 | Gaillaume | 273/248 |
| 2,194,854 | 3/1940 | Howard | 273/248 |
| 3,033,572 | 5/1962 | Thibault | 273/243 |
| 4,229,008 | 10/1980 | Jameson | 273/261 |
| 4,261,574 | 4/1981 | Rogers | 273/253 |
| 4,515,370 | 5/1985 | Garcia | 273/258 |
| 4,695,056 | 9/1987 | Cornelson | 273/262 |
| 4,696,478 | 9/1987 | Farrell | 273/261 |

*Primary Examiner*—Benjamin Layno

*Attorney, Agent, or Firm*—Terry M. Gernstein

[57] ABSTRACT

A game includes a game board that is divided into a plurality of, each sector defined by a different color and representing home locations of gems. The white sector being the home location for diamonds, green the home location for emeralds, blue the home location for sapphires, etc. Each sector is divided into squares, and each square corresponds to a number on a six-sided die. A colored die having a different color on each face to correspond to the sectors, and a gem die having a representation of a gem on each face are also provided. Gem playing pieces are randomly placed on the squares according to the roll of the three dice. Players then move their game tokens along the squares according to the roll of the numbered die. Gems are captured by landing a player's gems token on a square containing a gem, and then rolling an appropriate number according to the rules. A captured gem is then taken to its home location for a player to receive credits. One player can capture the gems of another by rolling appropriate numbers.

7 Claims, 3 Drawing Sheets

GEM CAPTURE BOARD GAME

TECHNICAL FIELD OF THE INVENTION

The present invention relates to the general art of board game and to the particular field of board games in which playing pieces capture other pieces and move to a home zone.

BACKGROUND OF THE INVENTION

There are many types of board games in which pieces are moved about playing areas on the board, and some of these games involve piece-capture rules.

However, the present inventor is not aware of any piece-capture board games which involve precious gems and the power of such gems.

Therefore, there is a need for a game which can entertain using precious gems, as well as instruct users regarding such elements.

OBJECTS OF THE INVENTION

It is a main object of the present invention to provide a game which can entertain using precious gems.

It is another object of the present invention to provide a game which can entertain using precious gems as well as instruct users regarding such elements.

SUMMARY OF THE INVENTION

These, and other, objects are achieved by a board game and set that is based on a gem hierarchy which roughly approximates the relative value of various precious gems. The player having the most points at the end of the game wins, and points are awarded according to the value of a gem captured by each player. Various strategies can also be worked out as well.

In this manner, the players learn about gems while capturing and stealing such precious items thereby adding elements of intrigue and competition to the game.

BRIEF DESCRIPTION OF THE DRAWING FIGURES

DETAILED DESCRIPTION OF THE PREFERRED EMBODIMENT OF THE INVENTION

Figure 1:
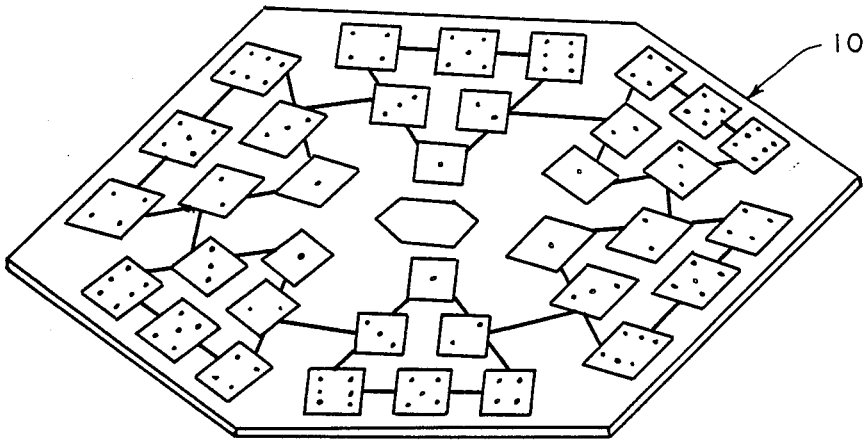
FIG. 1 is a perspective view of a game board used in the game of the present invention.
Figure 2:
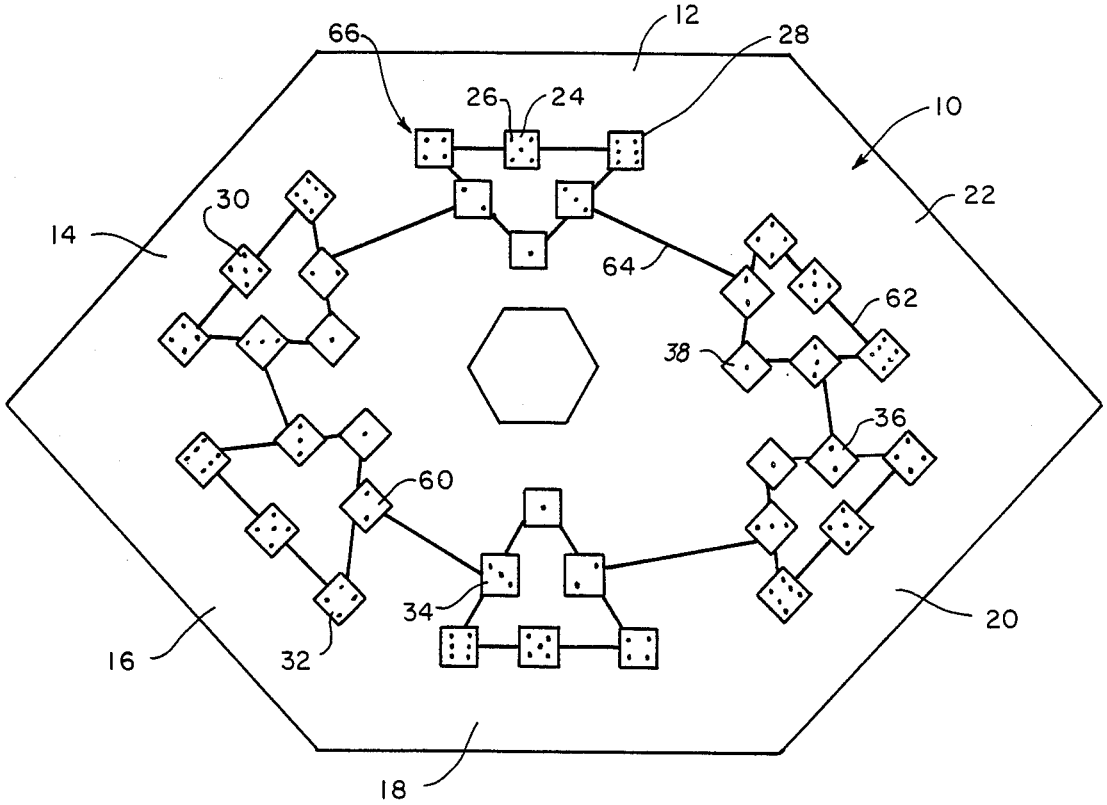
FIG. 2 is a top plan view of the game board.

The game of the present invention is played using a board 10 shown in FIGS. 1 and 2. The board 10 is hexagonal in peripheral shape, but could be other shapes as well, and is made of any suitable material, and can be collapsible and foldable if suitable.

The board 10 is divided into six colored zones, 12, 14, 16, 18, 20 and 22, each having a triangular configuration of squares, such as square 24 in zone 12. Each zone corresponds to a particular gem, as will be discussed below, and the colors can correspond to the color of the gems. For example the zones 12–22 can be colored white (for diamond) green (for emerald), red (for ruby), blue (for sapphire), yellow (for topaz) and purple (for amethyst), respectively.

Each square includes indicia, such as dot 26 on square 24, to indicate a value of such square. The dots 26 correspond to the markings on a six-sided cubical die as will be seen below. Each zone also has a home square, with the home square having the number of dots that correspond to the "strength" of the gem to which the zone corresponds. Thus, for example, the diamond is assigned a value of six since it is the most precious of the gems used in the game, and thus the diamond area 12 has a home square 28 which is the square having six dots thereon. The other areas have corresponding home squares 30, 32, 34, 36 and 38.

Figure 3A:
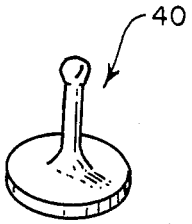
FIGS. 3A and 3B are perspective views of two game pieces that are used in the game of the present invention.
Figure 3B:
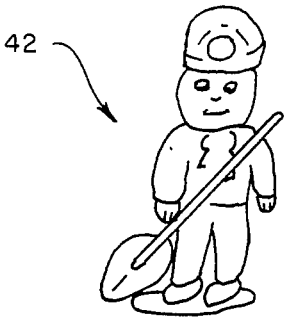
Figure 4A:
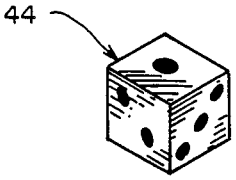
FIGS. 4A, 4B and 4C show various dice used in the game of the present invention.
Figure 4B:
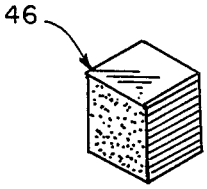
Figure 4C:
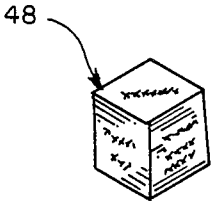
Figure 5:
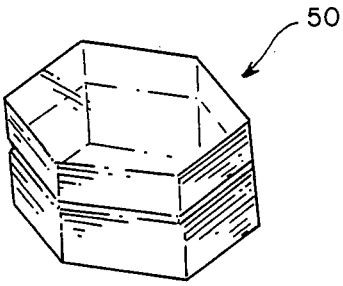
FIG. 5 is a perspective view of a container used in the game of the present invention.
Figure 6:
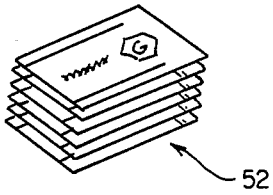
FIG. 6 shows a perspective of gem cards used in the game of the present invention.
Figure 7A:
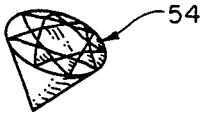
FIGS. 7A, 7B and 7C show various gem-like playing pieces.
Figure 7B:
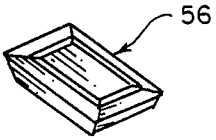
Figure 7C:
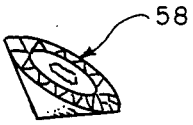

The game set also includes tokens, such as the tokens 40 and 42 shown in FIGS. 3A and 3B respectively, and these tokens are moved about the board according to the method of play as will be described below. The game set also includes several cube-shaped dice: number die 44; colored die 46 and gem die 48 as shown in FIGS. 4A, 4B and 4C for the purposes as will be explained below, and a gem container 50 as shown in FIG. 5 as well as a gem credit card 52 (FIG. 6) and playing pieces, such as 54, 56 and 58 shown in FIGS. 7A, 7B and 7C respectively and which represent the various gems associated With the game. The gem container is used to store gems for use during the game.

METHOD OF THE PLAY

The object of the game is to be the first player to collect three or more different gems for a total of twelve or more credits. As discussed above, the gems are assigned a value that roughly corresponds to the value of the gem relative to the other gems of the game, and these values are stated on the gem cards that are awarded when a player captures a particular gem lands on the gems's home square and has received the credit by rolling the proper value. The banker holds the gem cards. Thus, the diamond is assigned a value of six credits, the emerald five credits, the ruby four credits, the sapphire three credits, the topaz two credits and the amethyst one credit.

To begin play, each of the players selects a token and a banker is chosen. Each player then rolls die number 44 in combination with color die 46. The number that is up on the number die indicates what square the player begins the game on, and the color of the color die indicates the colored zone in which the player is to begin. For example, white, four indicates that the player is to place his token on square 66 in zone 12 to begin play.

Each player then rolls all three dies together to place the gems. The combination of the three dice indicates where the gem is to be placed. For example, if die 48 shows a diamond, die 46 indicates red and die 44 indicates two, then the diamond token, such as token 54, is initially placed in the red zone on the square with two dots, such square being shown in FIG. 2 at 60.

One player is chosen as the Banker and keeps the gem credit cards.

Play is begun by agreement or by tossing the number die 44, and proceeds clockwise about the board.

To obtain credits, a player must first be in possession of a gem(s). Then, he must move his token along the lines, such as line 62 or line 64, any number of connected squares up to the number that has been rolled on the number die to the home square of that particular gem only. Movement can only be controlled according to the number of the numbered die.

Once the token has landed on the gem home square, the player immediately rolls the numbered die and attempts to receive credit for his captured gem. If the number rolled is that of the home square on which the token rests, then the player loses his turn. If the number rolled is any other Value, then the player "cashes in" his captured gem by placing it back into the gem container and receives the corresponding credit from the bank. As will be discussed below, the player can lose the gem to another player, but will not lose the credits. The first player to capture a gem and move it into his bank account gets the credit for the gem. Thus, while a player is attempting to roll the proper number on the number die, another player can steal that same gem by using the above-described process and rolling the proper number on the number die before the first-mentioned player.

If a player has his token on the board square selected for initial placement of a gem, that player is automatically credited with the value of that gem, and another gem is placed on the board. A new gem is always placed on the board after a gem is captured using the above-described procedure. Each player can capture as many gems as possible.

To steal another player's gem (gems can be stolen, not credits), that is a gem that is already captured by that player, a player must land on the same square occupied by that player at the time of the "theft". The thief announces which gem owned by the "victim" that is to be the object of the "theft", and both players roll the number die. The high roller obtains possession of the gem. If the attacker rolls the high number, that thief takes the gem and rolls the number die again and moves with the gem. If the defender rolls the higher number or if there is a tie, the defender does not move, but receives any gem from the attacker if that attacker has gems in their possession. If either of the players has two or more of the same gems, then the theft can be of all of such same gems. A player can execute only one theft per turn for the same defender.

To win, a player must collect three or more different types of gems. The amount of credits needed to win depends on the number of players. For example, if there are two players, the winning credit number is twenty-four, three players, twenty-one credits, four players, eighteen credits, five players fifteen credits, and six players twelve credits.

As soon as one player reaches the winning credit number, the remaining gems in possession of all players and on the board are totalled. If any other player can tie or beat the Winner's score, with these gems added to his credit total, that player remains in the game, all others are eliminated. The eliminated players place their gems on the squares which are occupied by their tokens at the time of elimination. Play continues during this endgame portion using the gems on the board, and no new gems are added.

A descriptive booklet for gems, their history and the like can be included in the game set, and an electronic version of the game is possible.

It is understood that while certain forms of the present invention have been illustrated and described herein, it is not to be limited to the specific forms or arrangements of parts described and shown.

I claim:

1. A game set which includes:

a hexagonal game board having six squares disposed in a triangular fashion adjacent to each side of said board, each square having dots thereon which correspond in number from one to six, said squares being connected to form playing paths, each side of said board, containing said six squares, being a zone six different colors, with each color defining a zone a plurality of game tokens;

a number die for controlling the movement of said game tokens along the playing paths;

a color die having said six different colors, one color on each side thereof;

a gem die having different gems, one on each side thereof; and a plurality of gem-shaped playing pieces corresponding to said different gems, each different gem corresponding to a different zone.

2. The game set defined in claim 1 further including a gem container for storing playing pieces until needed.

3. A method of playing a game comprising providing a game set as defined in claim 2;

placing a gem playing piece on a square;

rolling the number die;

moving a playing token the number of squares corresponding to the number shown on the number die;

capturing a gem playing piece;

receiving credits for the captured piece;

stealing another player's gem pieces by one player.

4. The method defined in claim 3 wherein the step of capturing a playing piece includes steps of tossing the number die, landing on a square containing the piece to be captured, and rolling the number die again.

5. The method defined in claim 4 wherein the step of stealing another player's piece includes a step of rolling the number die by both players, having the player with the higher number win the piece, and having the another player capture the player's piece if that another player rolls a higher number than the player.

6. The method defined in claim 5 wherein the step of capturing a gem includes landing on the gem and moving the token to the corresponding home square to attempt to receive credit for the gem.

7. The method defined in claim 6 wherein the step of stealing another player's piece includes a step of the another player stealing the first-mentioned player's gem by the another player rolling a number that is higher or equal to the number rolled by the first-mentioned player.

* * * * *